US005620764A

United States Patent [19]

Schwarz et al.

[11] Patent Number: 5,620,764

[45] Date of Patent: Apr. 15, 1997

[54] INTERACTIVE WALL COVERING SYSTEM

[75] Inventors: Daniel A. Schwarz, Phila.; Craig B. Sobel, Wyncote, both of Pa.

[73] Assignee: Wall-Toons, Inc., Wyncote, Pa.

[21] Appl. No.: 382,516

[22] Filed: Feb. 1, 1995

[51] Int. Cl.[6] ..... B44C 5/04; E04F 13/00

[52] U.S. Cl. ..... 428/39; 428/79; 428/187; 428/904.4

[58] Field of Search ..... 428/15, 904.4, 428/79, 39, 187

[56] References Cited

U.S. PATENT DOCUMENTS

| | | | |
|---|---|---|---|
| 3,620,366 | 12/1969 | Parkinson et al. | 428/343 X |
| 4,015,352 | 4/1977 | Prange | 428/41 X |
| 4,143,495 | 3/1979 | Destito | 428/40 X |
| 4,225,369 | 9/1980 | Felchlin | 428/904.4 X |
| 4,264,666 | 4/1981 | Hix | 428/187 |
| 4,270,123 | 5/1981 | Chellus | 340/629 |
| 4,275,112 | 6/1981 | Savage, Jr. | 428/904.4 X |
| 4,362,944 | 12/1982 | Hendershot | 250/483.1 |
| 4,536,423 | 8/1985 | Travis | 428/14 |
| 4,676,376 | 6/1987 | Keiswetter | 206/494 |
| 4,684,264 | 8/1987 | Paperno et al. | 428/908.8 |
| 4,900,604 | 2/1990 | Martinez et al. | 428/904.4 X |
| 4,992,121 | 2/1991 | Rubino | 428/904.4 X |
| 5,162,138 | 11/1992 | Caflisch et al. | 428/17 |
| 5,196,246 | 3/1993 | Kauss et al. | 428/39 |
| 5,525,383 | 6/1996 | Witkowski | 428/30 |

*Primary Examiner*—Henry F. Epstein

*Attorney, Agent, or Firm*—Woodcock Washburn Kurtz Mackiewicz & Norris

[57] ABSTRACT

An interactive wall covering system having at least one substrate sheet and at least one non-adhesive applique which is easily mounted on and easily removed from the substrate sheet. The applique is made of an electrostatic cling material. The substrate sheet has one face receptive to an adhesive for permanently mounting the substrate sheet to a wall. The substrate sheet also has a second face receptive to an electrostatic cling material.

14 Claims, 4 Drawing Sheets

INTERACTIVE WALL COVERING SYSTEM

FIELD OF THE INVENTION

The present invention relates generally to wall covering systems. More specifically, the present invention relates to an interactive wall covering system using electrostatic cling appliques which are easily removable and easily positionable on a wall covering substrate permanently adhered to a wall surface.

BACKGROUND OF THE INVENTION

There are many methods for covering walls, including painting, panelling and wall papering. Each of these methods can involve the use of different materials, patterns and colors to produce a variety of decorative wall surfaces. When applying a wall covering by one of these methods, the decorative aspect is considered permanent—to change the decorative aspect, the present wall covering must be removed, replaced or covered over by a new wall covering.

In order to change the appearance of a wall (or room), a new wall covering or wall covering system must replace the old wall covering in a manner that does not allow the old wall covering (and its decorative design or theme) to be reused. For example, if a wall is repainted, the new paint is applied directly on top of the old paint. In the case of wall paper, the old paper must first be "stripped" from the walls before new wall paper can be applied or covered by the new wall paper. In either case, the old wallpaper (and its decorative design or them) is not reuseable.

Wall coverings may be changed for a number of reasons including changes in style, changes in how the room containing the wall covering is used or damage to the existing wall covering. Changing a decorative design or theme by replacing a wall covering is done infrequently for various reasons.

One reason which often limits the frequency in which wall coverings are changed is cost. A professional is usually required to apply a new wall covering. Changing a wall covering further involves replacing the wall covering over the entire wall or walls on which the old wall covering is affixed.

Another factor which affects the frequency in which a decorative design or theme of a room is changed is the confusion, disruption and untidiness, which is involved by replacing a wall covering. The task of surface preparation may involve sanding, stripping and scraping before a new wall covering can be applied. The byproduct is often dust, dirt and debris. If the new wall covering is paint, there is a risk of paint spills and splattering. If the new wall covering is wall paper, there is a risk of glue spills. When applying either type of wall covering, there is equipment which requires space and must be moved around and repositioned throughout a room.

Disruption to the user's home further limits the likelihood that a wall covering will be replaced or changed on a more frequent basis. Painting and wall papering require time to prepare the previously used surface. In addition, the application of a new wall covering usually requires a drying period, as well as a clean up period, both of which add to the disruption of the user's home.

Aside from the above described shortcomings and limitations, existing wall covering systems are also not interactive. Instead, existing wall covering systems are used decoratively, only for covering the surface of a wall and not as part of a play area for children. Existing wall covering systems are not designed for children to play "on the wall covering".

Although decorative objects can be applied to most wall coverings with pins, glue, thumbtacks, tape and adhesives, each of these methods of adhesion can leave permanent and unsightly marks on the wall covering and may even damage the underlying wall. In addition, repeated mounting and remounting of objects to a wall covering by these methods increases the damage to not only the wall covering and the wall, but also to the object. Existing wall covering systems which allow mounting of objects, are not well suited for true interactivity where a child can create or play "on the wall covering".

One example of a wall covering system which allows objects to be mounted on the wall covering is cork or "bulletin board" type coverings. Both have been used on walls in bedrooms and classrooms. Cork wall coverings, however, can crumble and break into small pieces. Cork is traditionally sold in only one color, brown, and is thus not well suited for decorative purposes. Also, cork is not produced with mural-sized background designs, patterns and themes applied to the cork surface. Objects mounted on cork are usually held in place with pins or thumbtacks which can pose a danger, particularly to small children.

Velcro™ (a hook and loop fastener) and felt surfaces have also been used for the removable mounting of objects. These wall coverings have limitations in the background images which can be applied to the surface. Like cork, the texture of the surface of these materials is not well suited for the application of a background image. If a background image was applied to a Velcro or felt wall covering, the effectiveness of mounting an object on the wall covering may be diminished considerably, due to the surface being coated or covered by materials (such as paint) which inhibit adhesion. While Velcro usually forms a secure mount between an object and a wall covering surface, felt does not. Wall coverings having these materials may also attract and retain dust and dirt particles, which may pose health concerns. Felt objects are also easily damaged and not easily cleaned.

U.S. Pat. No. 4,900,604, entitled Adhesive Wall Decorating System discloses a wall decorating system using appliques with an adhesive back for adhering to a substrate material. This wall covering system has several disadvantages if attempted to be used as an interactive wall covering system.

First, the removability of the substrate material requires that the adhesive used is relatively weak. Thus, the non-permanent adhesive coating used on the back of the appliques will eventually lose its adhesive quality if removed and reapplied over time. A similar result will affect the substrate surface, which also uses a non-permanent adhesive to secure it to a wall surface. Repeated use, particularly by children, can result in dirt adhered to the adhesive surface of the appliques which can not be cleaned without damage to the adhesive. Repeated removal of the appliques also cause the appliques to curl. This combined with the weakening of the adhesive over time promotes an ineffective and unsightly bond between the appliques and the substrate.

Other types of wall coverings which are not interactive in nature, yet create a thematic design on a wall are commonly referred to as "wall paper murals". This type of wall covering provides a selected image, such as a beach scene or golf course which is applied to a wall surface in a panel fashion. Each panel has a width and a height dimension, each of which is typically less than 50 to 60 inches. Since standard walls are approximately eight feet in height, each panel of a wall mural must be aligned with at least two other panels when applied to a wall surface. This results in an increased number of seams, which are visible to a user, particularly horizontal seams. This is in contrast to conventional wall paper which is sold in rolls which extend from floor to ceiling.

One reason why wall paper murals are printed and sold in panels and not rolls is that conventional wall paper has patterns which are repeated at preset intervals due to limitations of traditional offset printing presses. These types of presses can print a length (or height) corresponding to the diameter of the print drum on the printing press. One revolution of the print drum constitutes a single image pattern. To print an eight foot image (the height of a wall in a typical room) using traditional offset printing methods, requires an offset press with an eight foot diameter print drum. A print drum of this size is approximately twice the size of a standard print drum. Thus, such a printing press would be prohibitively expensive.

Other printing methods, such as silk screening, could be used to produce large sections, but this process is not as well suited for mass production as is offset printing and thus involves a higher associated cost to produce a product.

Electrostatic cling (or "static cling") material , such as electrostatic vinyl is known for its ability to form a friction based bond with surfaces made from the same material, as well as other high gloss surfaces such as glass. Static cling material is used, for example, for labels applied to sunglass lenses, decorative appliques for windows and in toys known as Colorforms™.

SUMMARY OF THE INVENTION

The present invention comprises an interactive wall covering system having at least one substrate sheet and at least one non-adhesive applique which is easily mounted on and easily removed from the substrate sheet. The applique is made of an electrostatic cling material. The substrate sheet has one face receptive to an adhesive for permanently mounting the substrate sheet to a wall. The substrate sheet also has a second face receptive to an electrostatic cling material.

In one embodiment of the present invention, a background image is applied to the second face of the substrate sheet which is thematically related to the applique. A coating can be optionally applied to the image and substrate layers to enhance the electrostatic cling bond between substrate sheet and applique.

In another embodiment, an image modifying applique is used to change the theme of the background image without having to remove or replace a substrate sheet which has been permanently mounted to a wall.

In still another embodiment, the appliques have moving parts.

BRIEF DESCRIPTION OF THE FIGURES

The invention will now be described by way of non-limiting example, with reference to the attached drawings in which.

DETAILED DESCRIPTION

Figure 1:
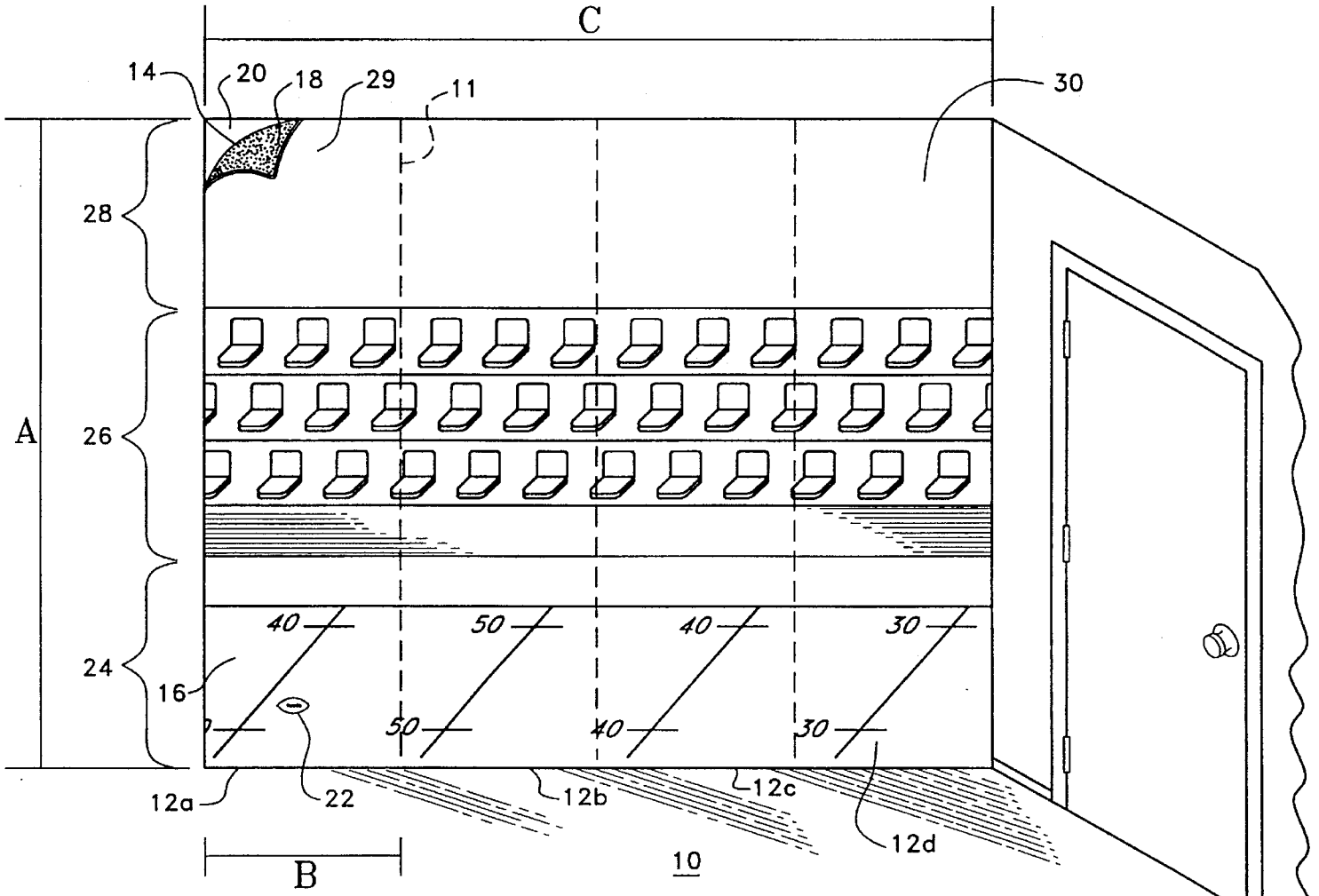
FIG. 1 is a perspective environmental view of an exemplary embodiment of the present wall covering system applied to one wall of a room.
Figure 2:
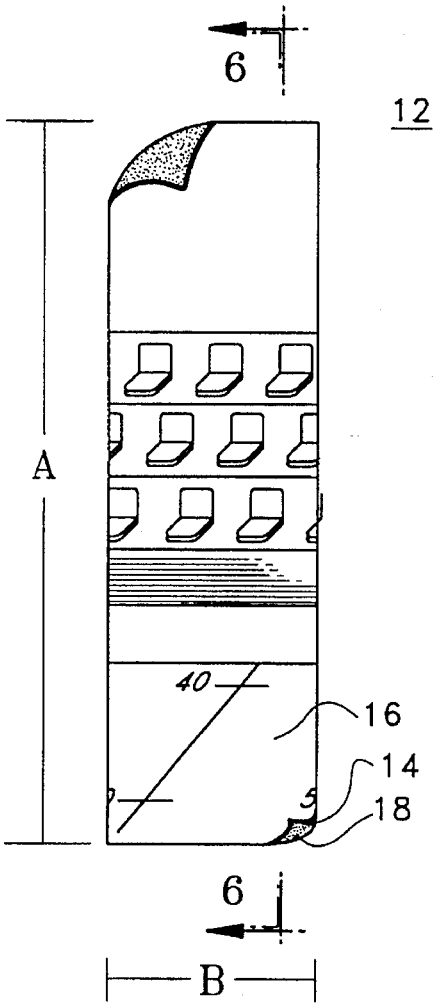
FIG. 2 is a front elevational view of a single substrate sheet shown in FIG. 1.
Figure 3:
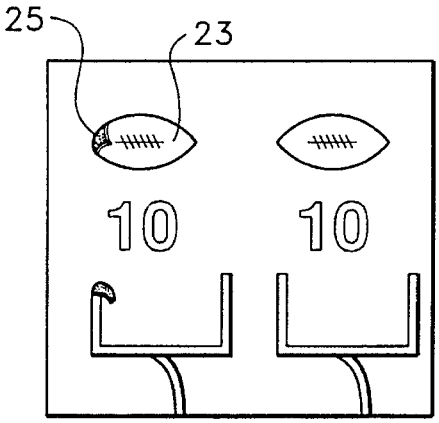
FIG. 3 is a front elevational view of an applique sheet containing several appliques which can be applied to the substrate sheet shown in FIGS. 1 and 2.

There is shown in FIGS. 1, 2 and 3 an exemplary interactive wall covering system 10 in accordance with the present invention. System 10 is comprised of at least one substrate sheet 12 having a first face 14 and a second face 16. First face 14 is receptive to an adhesive 18 for permanently adhering substrate sheet 12 to a wall surface 20. Second face 16 is imprinted with an image 29 which serves as a background image. Background image 29 provides a theme or design. Second face 16 is receptive to a friction bond with an electrostatic cling material and/or applied with a coating 56 which is receptive to a friction bond with an electrostatic cling material.

System 10 also includes at least one non-adhesive applique comprised of an electrostatic cling material, such as applique 22. Applique 22 has a first face 23 and a second face 25. Applique 22 is adapted to be easily removed and easily repositioned on a substrate sheet 12 via a friction bond ("electrostatic cling" bond). In an alternate embodiment, a coating or surface receptive to a friction bond is applied to at least one face of applique 22.

The exemplary embodiment of system 10 shown in FIG. 1 includes four substrate sheets 12*a*–12*d* applied side by side on wall surface 20 to give the appearance of a single combined image 30, in this case a football stadium. Although four substrate sheets 12 are shown, System 10 is designed to use as few as a single substrate sheet 12 or as many substrate sheets 12 as are necessary to cover a desired wall surface. Each substrate sheet 12*a*–12*d* shown in FIG. 1 is identical and is imprinted with a background image 29 which is a portion of combined background image 30. Background image 29 shown in FIGS. 1 and 2 includes a football field section 24, a bleachers section 26 and a sky section 28.

The image imprinted on each substrate sheet 12 has a height which extends from floor to ceiling (dimension A), which is typically eight feet. When mounted to wall surface 20 with an adhesive 18, substrate sheet 12 can be trimmed to the exact height dimension A of wall surface 20. Image 29 is such that trimming the height of substrate sheet 12 to fit a particular wall will not have any detrimental effect to the overall appearance of image 30. Each substrate 12 is permanently mounted to wall surface 20 in the normal fashion that wall paper is applied and is understood by those skilled in the art.

Substrate sheet 12 also has a width dimension B. Substrate sheet 12 is designed to be mated with additional substrate sheets 12 to form a single combined image 30 over length C of wall surface 20. Substrate sheet 12 can also be trimmed to the exact width (dimension B) of wall surface 20. Image 29 is such that trimming the width of substrate sheet 12 to fit a particular wall will not have any detrimental effect to the overall appearance of image 30. In FIG. 1, image 30 is shown on a single wall of a room. The number of walls on which System 10 is mounted is a design choice of the user.

A single applique 22 is shown in FIG. 1 to illustrate the interactivity of System 10. Interactivity requires that objects are capable of being easily removed and easily repositioned without damage to the wall covering, the wall or the applique. Applique 22 is a foreground applique which is removable and repositionable on a background image 29. Applique 22, which is shown as a football in FIG. 1, is thematically related to and interactive with image 30. Additional foreground appliques, such as those shown in FIG. 3 can be used simultaneously with applique 22, thereby expanding the diversity, the complexity and the interactivity of the themes/games created by the user. Applique 22 not only adheres to substrate sheet 12, but also to itself and other appliques.

Background image 29 of System 10 can also be modified or changed by applying complimentary appliques which are placed over designated areas on a background image 29. A complimentary background applique, such as image modifying applique 32 creates a new background theme/design for interaction by users, without the need to remove and replace substrate sheets 12. Image modifying appliques 32 are easy to remove and replace as these appliques are mounted on substrate sheet 12 via electrostatic cling bonding. If multiple substrate sheets 12 are used, such as substrate sheets 12*a*–12*d*, image modifying applique 32 (or multiple image modifying appliques 32) can be used.

Figure 4:
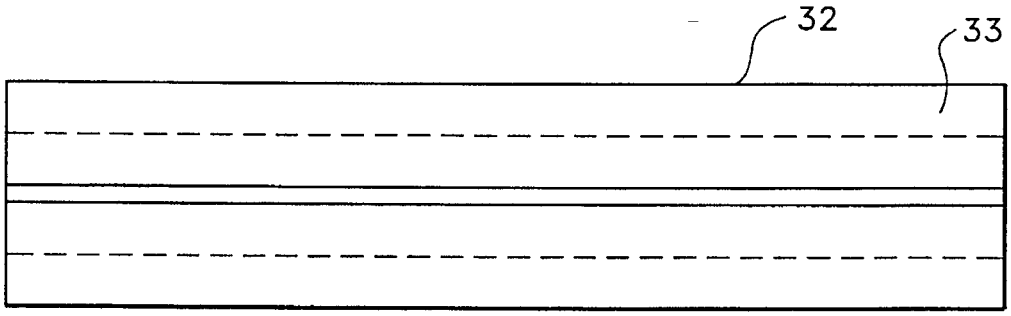
FIG. 4 is a front elevational view of an applique which can be applied over a large section of the image shown in FIG. 1 to change the image.

For example, football field section 24 can be completely covered with a second background image imprinted on an image modifying applique 32 shown in FIG. 4. Image modifying applique 32 is shown with a roadway or race track section image 33. Image modifying applique 32 is comprised of an electrostatic cling material and is mounted on substrate 12 similar to the manner in which applique 22 is applied.

Image modifying applique 32 can be produced in either section form or roll form. If produced in roll form, it could be applied over several substrate sheets 12, such as substrate sheets 12*a*–12*d*. If produced in section form, image modifying applique could be pieced together to form the desired new image. Image modifying applique 32 when applied to one or more substrate sheets 12 covers at least a section of the first background image, visually converting the theme of the first background image into a new or second theme, corresponding to the background image imprinted on image modifying applique 32. In this way, the football stadium theme of substrate sheet 12 shown in FIG. 1 can be converted into a racetrack or parade by covering football field section 24 of image 29 with racetrack/roadway image 33 on image modifying applique 32 shown in FIG. 3. By using a set of foreground appliques 22 (not shown) having a corresponding racetrack or parade theme, the user can play and interact with a racetrack or parade. A user can easily go back and forth between background themes by changing one or more sections of a background scene with image modifying appliques 32. Other sections of an image 29 can also be changed with image modifying appliques 32. For example, sky section 28 can be changed to portray a "night scene" for a night football game.

By using substrate sheet 12 with its background scene, appliques 22 as foreground objects and image modifying appliques 32 to change the background scene of image 30, many new and exciting interactive games, adventures and activities can be created and played. Appliques 22 and 32 will remain in place via the electrostatic cling bond for long periods of time.

Figure 5:
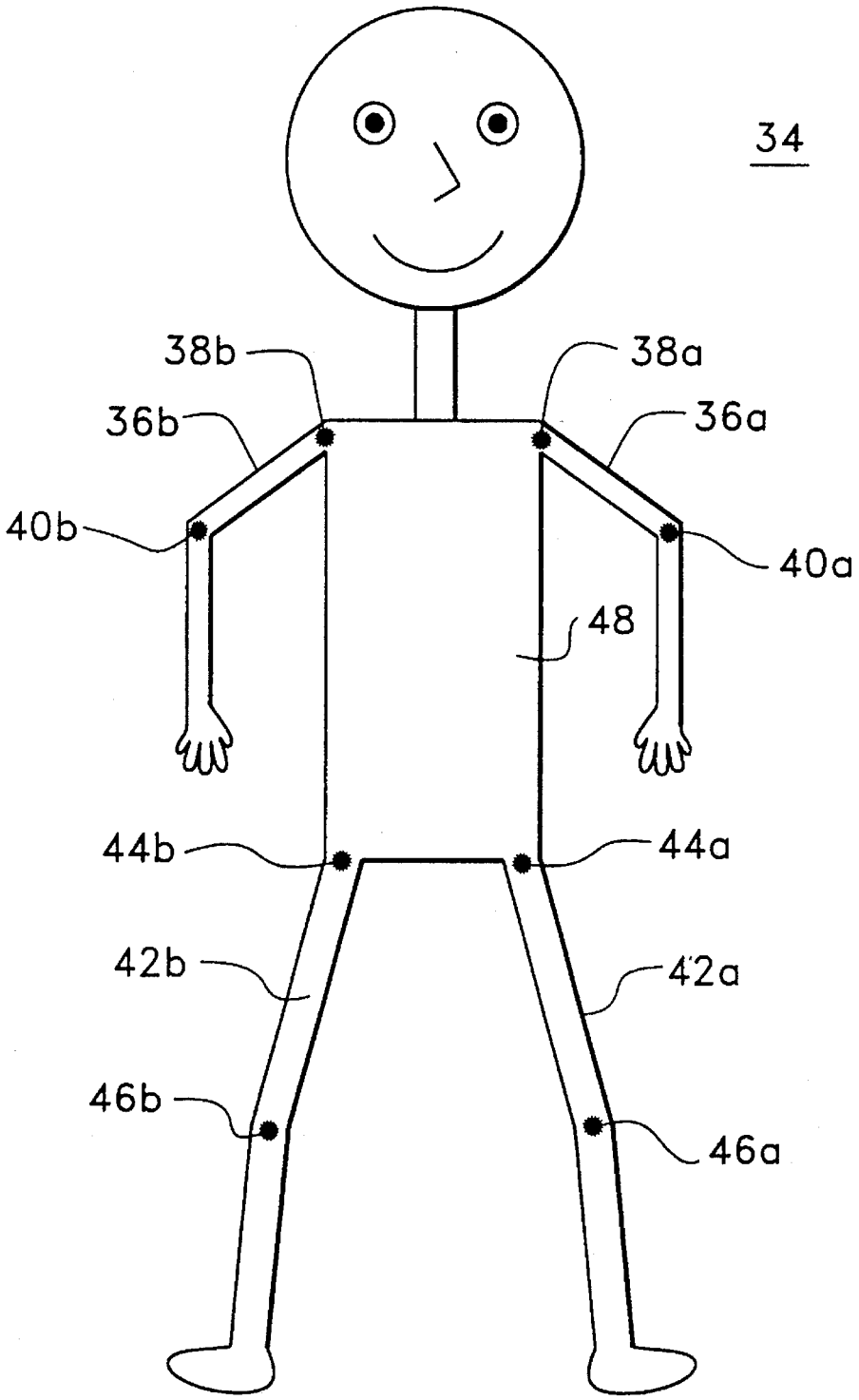
FIG. 5 is a front elevational view of an applique with movable parts.

There is shown in FIG. 5 an applique 34 having a number of movable appendages. Applique 34 is shown as a figurine with movable arms 36*a* and 36*b* with shoulder pivot points 38*a* and 38*b* and elbow pivot point 40*a* and 40*b*, respectively. Applique 34 also has movable legs 42*a* and 42*b* with hip pivot points 44*a* and 44*b* and knee pivot points 46*a* and 46*b*.

Applique 34, like applique 22 is made of an electrostatic cling material. Applique 34 has pivot points which can be made out of electrostatic cling material, plastic or other suitable material. The pivot points are made by punching, cutting or molding a hole in the electrostatic cling material at the location of the desired pivot point and then applying a "rivet" of electrostatic cling material, plastic or other suitable material to hold the respective parts together and allow movability.

For example, arm 36*a* is connected to body 48 at pivot point 38*a*. Pivot point 38*a* is a "rivet" holding a secondary section (arm 36*a*) to a primary section (body 48), while allowing motion of arm 36*a* relative to body portion 48. Although only two sections are shown connected at any one pivot point, multiple sections could be connected at a pivot point, so long as each section remains movable the applique can still be mounted to a substrate sheet 12 via electrostatic cling bonding.

A movable applique 34 can be mounted onto substrate sheet 12, image modifying applique 32 or appliques 22 in a variety of positions, adding to variations in games and adventures which can be played out. Applique 34 could be repositionably mounted on substrate sheet 12 shown in FIG. 1 as a quarterback. The figurine could then be placed in several action positions such as throwing a football (applique 22), running, etc.

MATERIALS AND MANUFACTURE

Figure 6:
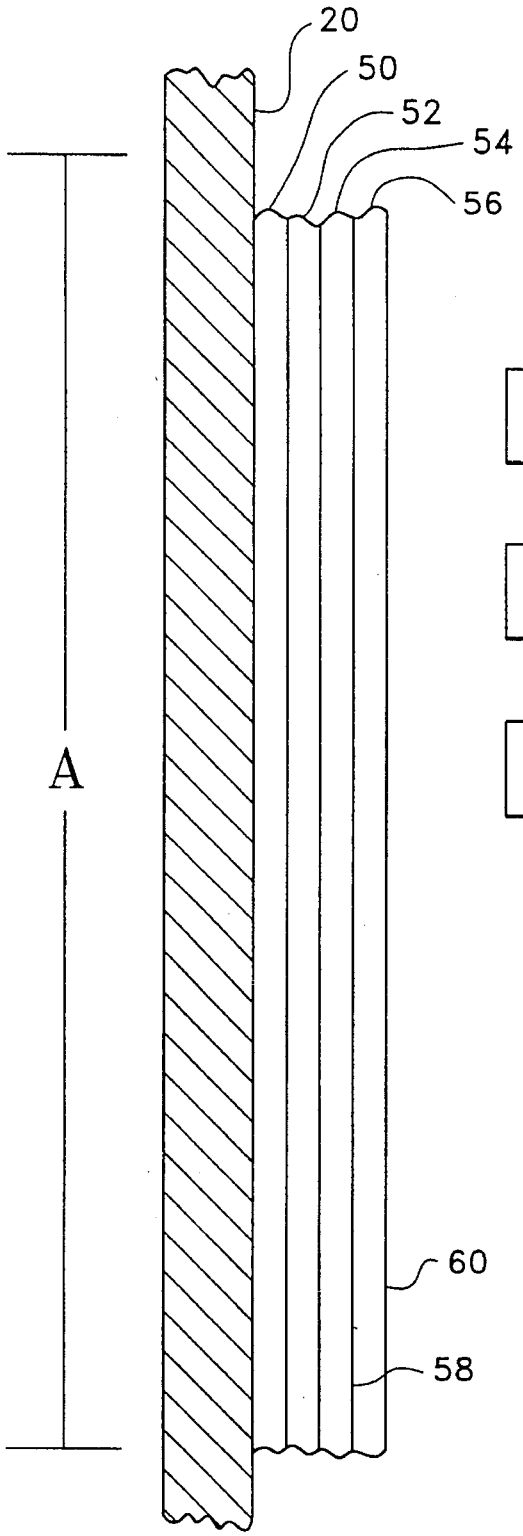
FIG. 6 is a cross sectional view of a substrate sheet in accordance with the present invention.

Referring now to FIG. 6, a cross sectional view of an exemplary embodiment of substrate sheet 12 is shown, comprised of a base layer 52 having a first face and a second face. A permanent adhesive layer 50 is applied to the first face and positioned between base layer 52 and wall surface 20. Adhesive 50 can be applied to the first face of base layer 52 at the time substrate sheet 12 is being hung on wall surface 20 or at the time of manufacture.

An image layer 54 is imprinted on the second face of base sheet 52. Image layer 54 includes image 29 (not shown). Although shown covering substrate sheet 12 along the entire height A of substrate sheet 12, image layer 54 may only cover a portion of a second face of base layer 52.

In an exemplary embodiment, base layer 52 is made of a paper stock. The paper stock should be receptive to static cling bonding, having a high gloss, very smooth surface. A cast-coated paper has a smooth surface and also has good ink holdout—the ink "sits" on top of the paper stock with limited absorption and dispersion throughout the paper stock as compared to non-coated paper. Kromekote™, by Champion International Corporation, is an example of a cast-coated paper having the desired electrostatic cling receptiveness.

In an additional embodiment, a laminate coating 56 is applied on top of image layer 54 to enhance electrostatic cling bonding with appliques. Coating 56 covers image layer 54 and any portion of the second face of base layer 52 which is not covered by image layer 54. In this manner, the entire second face of substrate sheet 54 is covered by coating 56.

Coating 56 can be a liquid or film laminate, so long as the ultimate finish is receptive to electrostatic cling bonding. In liquid form, an example coating 56 is a clear coat ink or varnish. In film form, an example coating 56 is a polyethylene film. Coating 56 may have additional properties, such as ultra-violet (UV) protection. In order to display an image 29 through a coating 56, however, coating 56 should be substantially clear.

Base layer 52 can also be constructed from an electrostatic cling materials such as polyvinyl chloride (PVC), polyurethane, polypropylene and polyethylene. These materials, particularly PVC, may be enhanced with various stabilizers, additives and plasticizers to prevent degradation of elasticity from ultra violet radiation, while also increasing the flexibility of the material. A coating 56 can also be applied to the PVC or other material receptive to electrostatic cling to enhance the electrostatic cling bonding.

Figure 7:
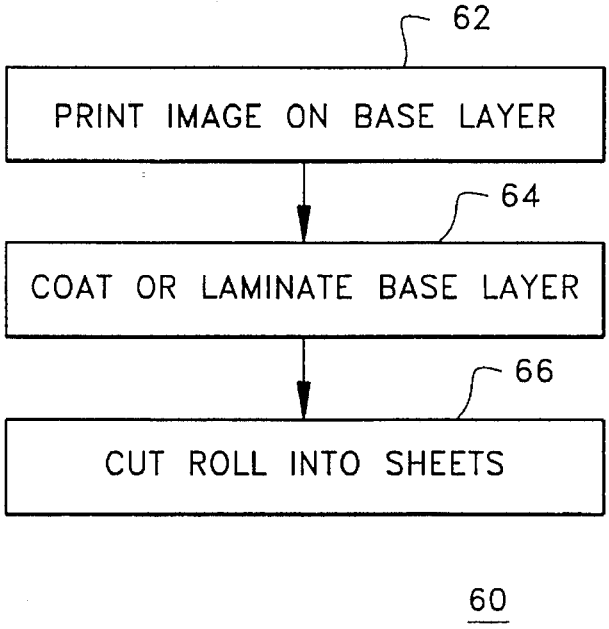
FIG. 7 is a flow chart illustrating the process of manufacturing substrate sheets in accordance with the present invention.

There is shown in FIG. 7, a flowchart illustrating an exemplary process 60 for manufacturing a substrate sheet 12 in accordance with the present invention. In process 60, an image 29 is printed onto a base layer 52 as shown in block 62. The printing is done in continuous or roll form to minimize production costs. This requires continuous feed of material (base layer 52) through a printing press. Following printing, a laminate or coating receptive to electrostatic cling is applied to the entire roll to create or increase the level of electrostatic cling bonding. The roll is then cut into individual substrate sheets 12.

In order to imprint an image 29 on a substrate sheet 12, an offset press such as a gravure press may be used for the printing. Because substrate sheet 12 is designed to be applied to a wall which is approximately eight feet in height, normal offset printing would require a printing drum with an eight foot diameter.

Normal offset printing drums typically have a diameter of less than 50 inches. Offset printing presses exist, however, which can handle sheets/rolls with a width of approximately 100 inches. Therefore, if the widthwise dimension of the printing press is used to print the vertical dimension of the image (the floor to ceiling dimension), a substrate sheet 12 of approximately four feet in width (the diameter of the printing drum) and eight feet in height (the 100 inch width of the printing drum) can be printed continuously in roll form. Such a printing method effectively rotates the image being printed 90 degrees from the normal printing method, in order to produce a single eight foot image without having to panel the image together in the vertical (height) dimension.

The next step of the process optionally laminates a substantially clear liquid or film coating 56 to base layer 52 and image layer 54. If a film, such as a polyethylene film is used as coating 56, the additional step of chill rolling is used to provide a high gloss finish which is receptive to electrostatic cling. If a clear varnish or ink is used instead of a polyethylene film, chill rolling is not necessary.

After a suitable electrostatic cling surface is present, the roll is cut into individual substrate sheets 12. Individual substrate sheets 12 can then be rolled up for sale to distributor or ultimate users.

While particular embodiments of the present invention are disclosed herein, it is not intended to limit the invention to such disclosure, and changes and modifications may be incorporated and embodied within the scope of the following claims:

What is claimed is:

1. An interactive wall covering system comprising:

a) at least one substrate sheet having a first face and a second face, said first face receptive to an adhesive for permanently adhering said substrate to a wall surface and said second face receptive to an electrostatic cling material; and b) at least one non-adhesive applique comprising an electrostatic cling material adapted to be removably mounted on said substrate sheet by electrostatic cling bonding.

2. An interactive wall covering system in accordance with claim 1 wherein said applique comprises:

a) a primary section; and b) at least one secondary section pivotally connected to said primary section and independently movable in relation to said primary section;

wherein said primary section and said secondary section are adapted to be repositionably mounted on said substrate sheet by electrostatic cling bonding.

3. An interactive wall covering system in accordance with claim 1 wherein said substrate sheet comprises:

i) a base layer having a first side and a second side, ii) an image layer applied to said second side of said base layer, and iii) a substantially clear, smooth coating applied to said image layer and receptive to adhesion by electrostatic cling bonding.

4. An interactive wall covering system in accordance with claim 3 wherein said image layer of said substrate sheet comprises a first background scene and said applique is a background applique having a second background image adapted to cover at least a portion of said first background scene, visually converting said first background scene into a second background scene.

5. An interactive wall covering system in accordance with claim 4 further comprising a foreground interactive applique comprising an electrostatic cling material adapted to be repositionably mounted on said substrate sheet or on said background applique by electrostatic cling bonding.

6. An interactive wall covering system in accordance with claim 4 further comprising a foreground applique including a foreground image thematically related to and interactive with said background scene.

7. An interactive wall covering system in accordance with claim 3 wherein said image layer for said substrate sheet comprises a background scene and said applique comprises a foreground object thematically related to and interactive with said background scene.

8. An interactive wall covering system in accordance with claim 3 wherein said base layer is comprised of a paper.

9. An interactive wall covering system in accordance with claim 8 wherein said paper base layer is comprised of a cast-coated paper.

10. An interactive wall covering system in accordance with claim 3 wherein said image layer is printed on said base layer by offset printing.

11. An interactive wall covering system in accordance with claim 3 wherein said substantially clear smooth coating is comprised of a chill rolled polyethylene film.

12. An interactive wall covering system in accordance with claim 3 wherein said substantially clear smooth coating is comprised of an ultra violet protecting, ink coating.

13. An interactive wall covering system in accordance with claim 3 wherein said applique is comprised of a plasticized polyvinyl chloride (PVC) material.

14. An interactive wall covering system in accordance with claim 3 wherein said base layer is comprised of a plasticized polyvinyl chloride (PVC) material.

* * * * *